US009568254B2

(12) United States Patent
Huang

(10) Patent No.: US 9,568,254 B2
(45) Date of Patent: Feb. 14, 2017

(54) HEAT TRANSFER PLATE AND HEAT PIPE MOUNTING STRUCTURE AND METHOD

(71) Applicant: Tsung-Hsien Huang, I-Lan Hsien (TW)

(72) Inventor: Tsung-Hsien Huang, I-Lan Hsien (TW)

( * ) Notice: Subject to any disclaimer, the term of this patent is extended or adjusted under 35 U.S.C. 154(b) by 265 days.

(21) Appl. No.: 14/517,842

(22) Filed: Oct. 18, 2014

(65) Prior Publication Data

US 2015/0276321 A1 Oct. 1, 2015

(30) Foreign Application Priority Data

Apr. 1, 2014 (CN) ..... 2014 1 0127963

(51) Int. Cl.
*F28D 15/02* (2006.01)

(52) U.S. Cl.
CPC ..... *F28D 15/02* (2013.01); *F28D 15/0233* (2013.01); *F28D 15/0275* (2013.01)

(58) Field of Classification Search
CPC ..... B23P 15/26; B23P 27/09; Y10T 29/49364; F28D 15/0275; F28D 15/0233; B21D 53/02; F28F 2275/12; F28F 2275/10
USPC ..... 29/890.038
See application file for complete search history.

(56) References Cited

U.S. PATENT DOCUMENTS 6,408,934 B1 * 6/2002 Ishida ..... F24F 3/1423 165/10
8,136,245 B2 * 3/2012 Lin ..... F28D 15/0275 29/890.032
9,327,369 B2 * 5/2016 Lin ..... B23P 15/26
2013/0120937 A1 * 5/2013 Liao ..... H01L 23/427 361/700
2015/0184948 A1 * 7/2015 Lin ..... F28D 15/02 165/104.21

FOREIGN PATENT DOCUMENTS

NO EP 0157370 A2 * 10/1985 ..... B21D 53/08

* cited by examiner

*Primary Examiner* — Tho V Duong
(74) *Attorney, Agent, or Firm* — Pai Patent & Trademark Law Firm; Chao-Chang David Pai

(57) ABSTRACT

A metal heat transfer plate and heat pipe mounting structure includes a metal heat transfer plate and heat pipes embedded in the metal heat transfer plate in a flush manner. The metal heat transfer plate and heat pipe mounting method includes the steps of punching mounting slots in a metal heat transfer plate, processing each mounting slot into a respective flanged hole, reversely stamping each flanged hole to form top and bottom protruding flanges around each mounting slot, stamping each bottom protruding flange to create an insertion chamber, and press-fitting a flat heat pipe into each mounting slot and then stamping each top protruding flange into a respective deformed top protruding flange to wrap about one respective heat pipe and to keep each deformed top protruding flange flush with the top surface of the metal heat transfer plate and each heat pipe.

1 Claim, 12 Drawing Sheets

HEAT TRANSFER PLATE AND HEAT PIPE MOUNTING STRUCTURE AND METHOD

BACKGROUND OF THE INVENTION (a) Field of the Invention

The present invention relates to heat sink technology, and more particularly to a heat transfer plate and heat pipe mounting structure and method for enabling a metal heat transfer plate and at least one flat heat pipe to be tightly fastened together in a flush manner.

(b) Description of the Prior Art

With fast development of modern technology, commercial mobile electronic devices, such as cell phone, notebook computer, tablet computer, iPad, PAD, GAS, etc., commonly have the flat, thin and compact characteristics with powerful computing capabilities. During operation of these mobile electronic devices, the internal CPU, IC and/or other heat generating components will generate a large amount of waste heat that must be quickly expelled to ensure normal functioning of the components and to prolong their lifespan.

For cooling a compact mobile electronic device, it is the common way to bond a metal heat transfer plate to the surface of the CPU, IC or any other heat generating component for absorbing waste heat and carrying waste heat away from the CPU, IC or any other heat generating component. However, this heat dissipation method has a low efficiency and cannot rapidly expel heat, and therefore a heat accumulation problem can occur easily, causing crash or component damage.

In order to accelerate heat dissipation, Taiwan Patent M459692 teaches the use of heat pipes with a metal heat transfer plate by means of directly bonding flat heat pipes to the surface of a metal heat transfer plate. A flat heat pipe for this application has a thickness about 0.6 mm. After the flat heat pipes are bonded to the metal heat transfer plate, the overall thickness of the combination will be larger than 0.6 mm. Thus, a mobile electronic device must provide a sufficient internal chamber for accommodating the metal heat transfer plate and heat pipe combination and other related components, increasing the device height. Therefore, the aforesaid prior art metal heat transfer plate and heat pipe combination is not practical for low profile application.

SUMMARY OF THE INVENTION

The present invention has been accomplished under the circumstances in view. It is therefore the main object of the present invention to provide a metal heat transfer plate and heat pipe mounting structure, which comprises a metal heat transfer plate and at least one heat pipe. Before installation of the heat pipe(s), the metal heat transfer plate comprises at least one mounting slot, opposing top and bottom protruding flanges respectively protruding from the opposing top and bottom surfaces thereof around each mounting slot, and an insertion chamber defined in each mounting slot and surrounded by the inner wall of the respective bottom protruding flange. After insertion of each heat pipe into the insertion chamber in one respective mounting slot in the metal heat transfer plate, each top protruding flange is deformed to wrap about one respective heat pipe in a flush manner.

It is another object of the present invention to provide a metal heat transfer plate and heat pipe mounting method for making a metal heat transfer plate and heat pipe mounting structure. The method comprises the steps of punching mounting slots in a metal heat transfer plate, processing each mounting slot into a respective flanged hole, reversely stamping each flanged hole to form top and bottom protruding flanges around each mounting slot, stamping each bottom protruding flange to create an insertion chamber, and press-fitting a flat heat pipe into each mounting slot and then stamping each top protruding flange into a respective deformed top protruding flange to wrap about one respective heat pipe and to keep each deformed top protruding flange flush with the top surface of the metal heat transfer plate and each heat pipe.

It is still another object of the present invention to provide a metal heat transfer plate and heat pipe mounting structure and method, which enables flat heat pipes to be embedded in respective mounting slots in a metal heat transfer plate in a flush manner so that the overall thickness of the finished metal heat transfer plate and heat pipe mounting structure is approximately equal to the thickness of the flat heat pipe, making the finished metal heat transfer plate and heat pipe mounting structure suitable for low profile application. Therefore, the finished metal heat transfer plate and heat pipe mounting structure of the present invention is practical for use in any of a variety of light, thin, compact electronic devices.

In an alternate form of the metal heat transfer plate and heat pipe mounting structure of the present invention, the metal heat transfer plate further comprises at least one thin strip suspending at a bottom side of each mounting slot for supporting each heat pipe in the insertion chamber in one respective mounting slot.

Further, in an alternate form of the metal heat transfer plate and heat pipe mounting method in accordance with the present invention, at least one thin strip is simultaneously produced in the first step to punch at least one mounting slot in a metal heat transfer plate. Thus, after one flat heat pipe is press-fitted into each mounting slot in the metal heat transfer plate, each inserted flat heat pipe is supported on at least one thin strip. After each top protruding flange around each mounting slot is stamped into a respective deformed top protruding flange to wrap about one respective heat pipe and to keep each deformed top protruding flange flush with the top surface of the metal heat transfer plate and each heat pipe, each inserted flat heat pipe is tightly secured to the inside of each respective mounting slot in a flush manner.

DETAILED DESCRIPTION OF THE PREFERRED EMBODIMENTS

Referring to FIGS. 1-4, a metal heat transfer plate and heat pipe mounting structure in accordance with a first embodiment of the present invention is shown. As illustrated, the heat transfer plate and heat pipe mounting structure comprises a metal heat transfer plate 1 and at least one, for example, a plurality of heat pipes 2.

Figure 1:
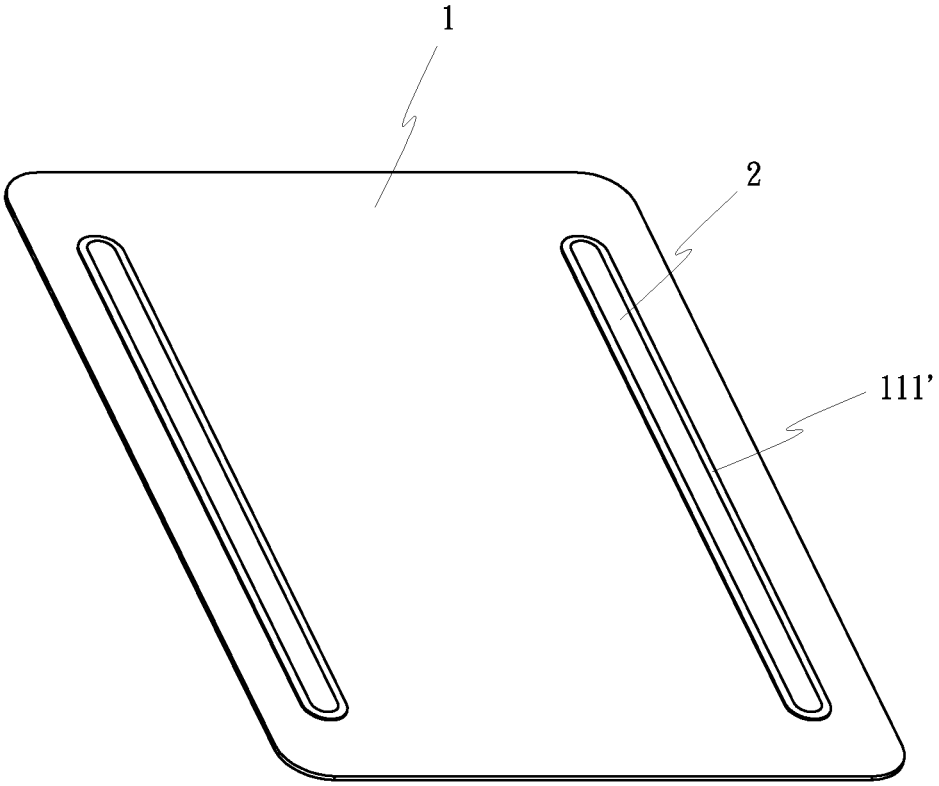
FIG. 1 is an oblique top view of a metal heat transfer plate and heat pipe mounting structure in accordance with a first embodiment of the present invention.
Figure 2:
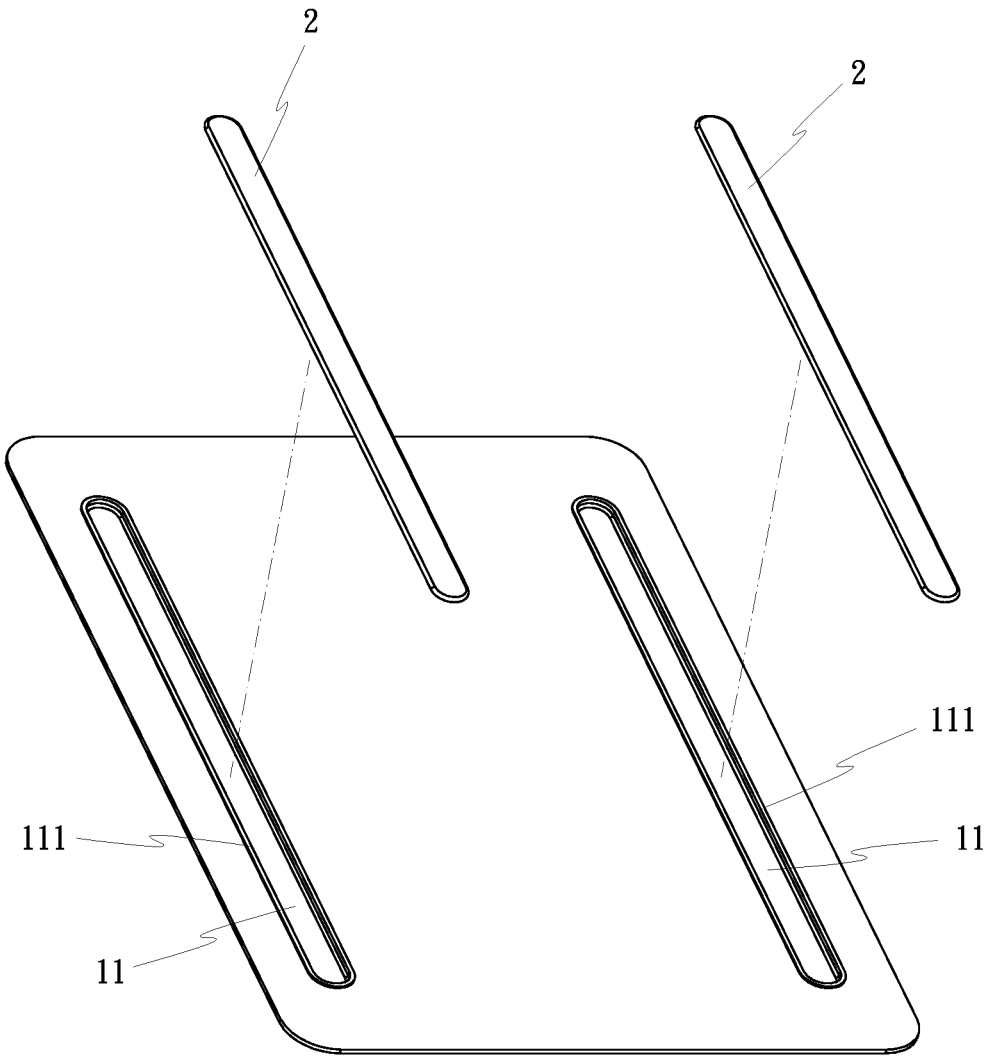
FIG. 2 is an exploded view of the metal heat transfer plate and heat pipe mounting structure in accordance with the first embodiment of the present invention.
Figure 3:
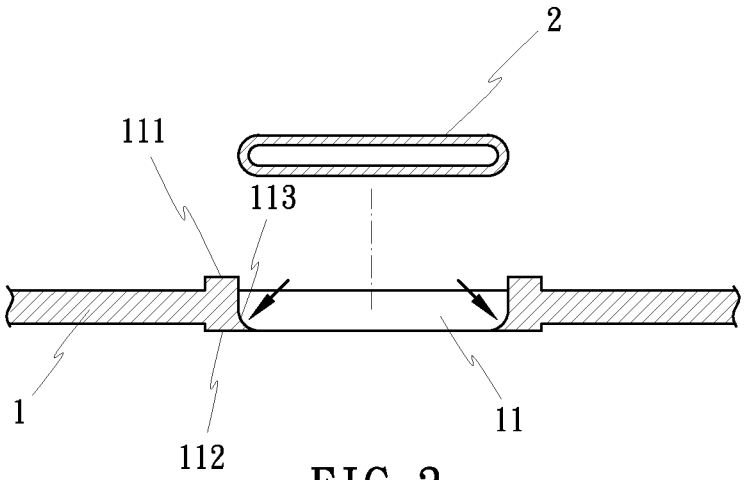
FIG. 3 is a schematic sectional view of the first embodiment of the present invention before installation of the heat pipe in the metal heat transfer plate.

The metal heat transfer plate 1, before mounting with the at least one heat pipe, comprises at least one, for example, a plurality of mounting slots 11 cut through opposing top and bottom surfaces thereof, an insertion chamber 113 defined in each mounting slot 11, a top protruding flange 111 upwardly protruding from the top surface of the metal heat transfer plate 1 around each mounting slot 11, and a bottom protruding flange 112 downwardly protruding from the bottom surface of the metal heat transfer plate 1 around each mounting slot 11 (see FIG. 3). Further, the insertion chamber 113 is defined within an inner wall of the bottom protruding flange 112.

The heat pipes 2 are flat pipes mating with the mounting slots 11 of the metal heat transfer plate 1.

Figure 4:
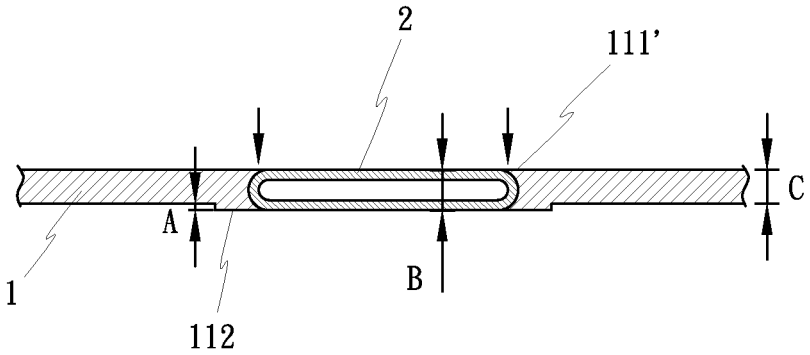
FIG. 4 corresponds to FIG. 3, illustrating the heat pipe installed in the metal heat transfer plate.

When fastening the metal heat transfer plate 1 and the heat pipe 2 to constitute the heat transfer plate and heat pipe mounting structure, each heat pipe 2 is inserted into the insertion chamber 113 in one respective mounting slot 11 of the metal heat transfer plate 1, and a stamping technique is employed to deform the top protruding flange 111 of each mounting slot 11, forcing the deformed top protruding flange 111' to wrap about a border area of the respective heat pipe 2 while keeping the deformed top protruding flange 111' flush with the top surface of the metal heat transfer plate 1 and the heat pipe 2 (see FIG. 4).

The flat heat pipes 2 have a thickness about 0.6 mm. The metal heat transfer plate 1 has a thickness in the range of 0.3~0.5 mm. The bottom protruding flange 112 around each mounting slot 11 has a height A approximately equal to the thickness B (about 0.6 mm) of the heat pipe minus the thickness C of the metal heat transfer plate 1 (about 0.3~0.5 mm), and therefore, the height A of the bottom protruding flange 112 is in the range of 0.3~0.1 mm, i.e., A=B−C (i.e., A+C=B).

In actual application, the height A can be properly increased to fit the requirements.

Therefore, it can be defined as: A+C≥B.

Similarly, the height of the top protruding flange 111 around each mounting slot 11 is approximately equal to the height of the bottom protruding flange 112, however, after the top protruding flange 111 is stamped into a deformed top protruding flange 111', the deformed top protruding flange 111' is wrapped about the heat pipe 2 and kept flush with the surface of the heat pipe 2.

According to the present first embodiment, the height A of the bottom protruding flange 112 is in the range of 0.3~0.1 mm. After the heat pipes 2 are embedded in the metal heat transfer plate 1, the heat pipes 2 are tightly secured to the metal heat transfer plate 1, and the total thickness of the finished metal heat transfer plate and heat pipe mounting structure is the same as the thickness of the heat pipe 2 for low profile application, and therefore the invention is practical for use in any of a variety of light, thin, compact electronic devices.

However, the thickness of the metal heat transfer plate 1 or the thickness of the heat pipes 2 are not limited to the aforesaid specifications, i.e., the thickness of the metal heat transfer plate 1 and the thickness of the heat pipes 2 can be changed to meet different application requirements.

Figure 5:
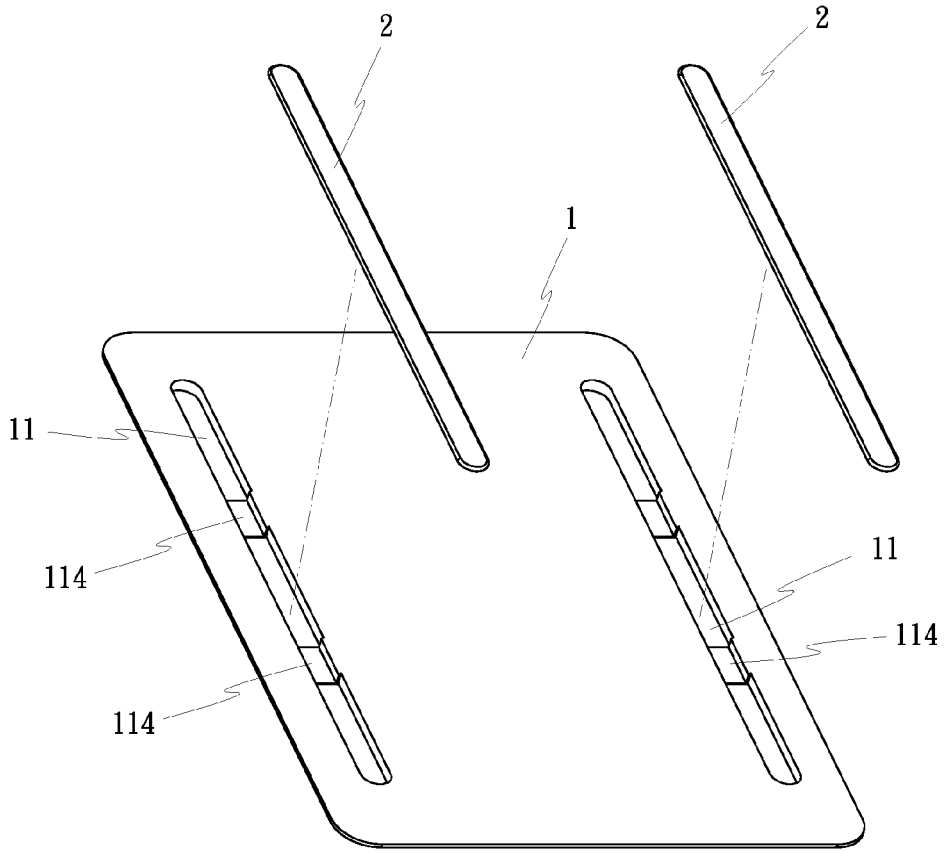
FIG. 5 is an exploded view of a metal heat transfer plate and heat pipe mounting structure in accordance with a second embodiment of the present invention.
Figure 6:
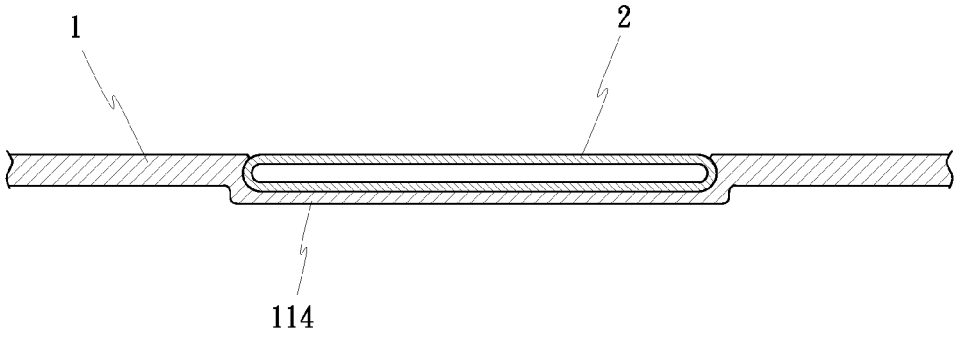
FIG. 6 is a sectional side view of the metal heat transfer plate and heat pipe mounting structure in accordance with the second embodiment of the present invention.

In a second embodiment of the present invention, as illustrated in FIG. 5 and FIG. 6, the metal heat transfer plate 1 of the metal heat transfer plate and heat pipe mounting structure further comprises a plurality of thin strips 114 transversely connected between two opposite lateral sides of each mounting slot 11 for supporting one respective heat pipe 2 in the insertion chamber 113 in one respective mounting slot 11 (see FIG. 6), and thus, each heat pipe 2 can be tightly secured in position in the respective mounting slot 1.

Actually, the aforesaid thin strips 114 are respectively connected between two opposite lateral sides of the bottom protruding flange 112 around each mounting slot 11 to support the bottom side of each heat pipe 2 in the respective insertion chamber 113.

Figure 7:
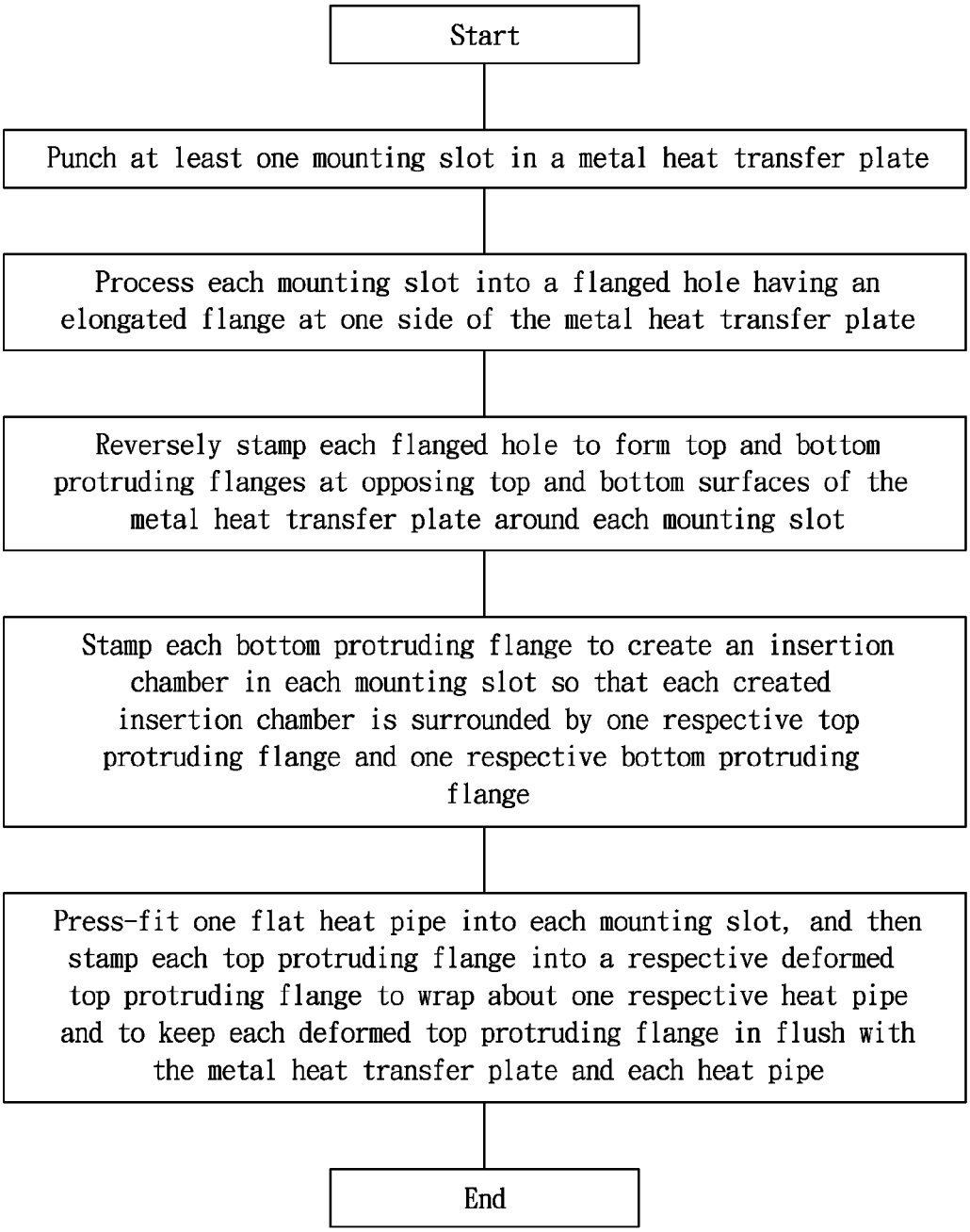
FIG. 7 is a manufacturing flow chart of the first embodiment of the present invention.

Referring to FIG. 7, a metal heat transfer plate and heat pipe mounting method for making the aforesaid metal heat transfer plate and heat pipe mounting structure in accordance with the first embodiment of the present invention comprises five processing steps.

Figure 8:
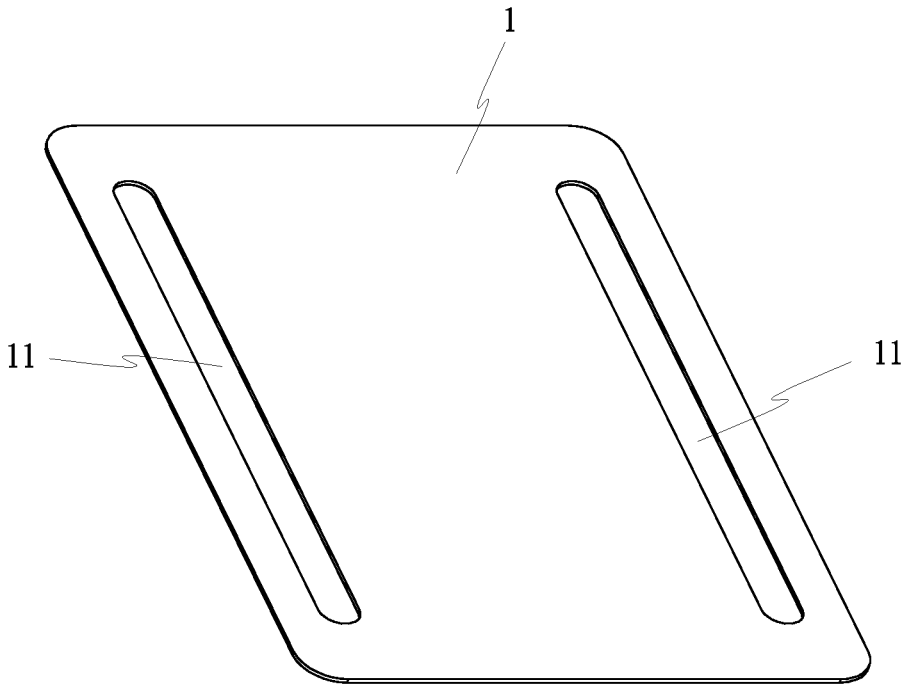
FIG. 8 illustrates mounting slots formed in the metal heat transfer plate after the first step of the metal heat transfer plate and heat pipe mounting method in accordance with the present invention.
Figure 9:
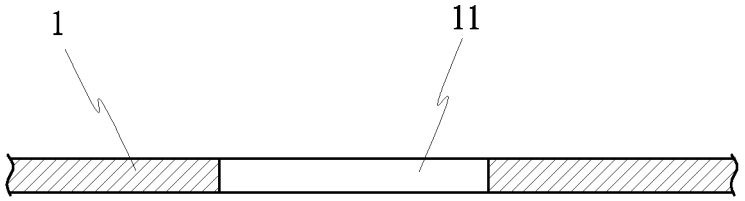
FIG. 9 is a sectional view of the metal heat transfer plate shown in FIG. 8.

Step I: Punch one or a plurality of mounting slots 11 in the metal heat transfer plate 1 (see FIG. 8 and FIG. 9).

Figure 10:
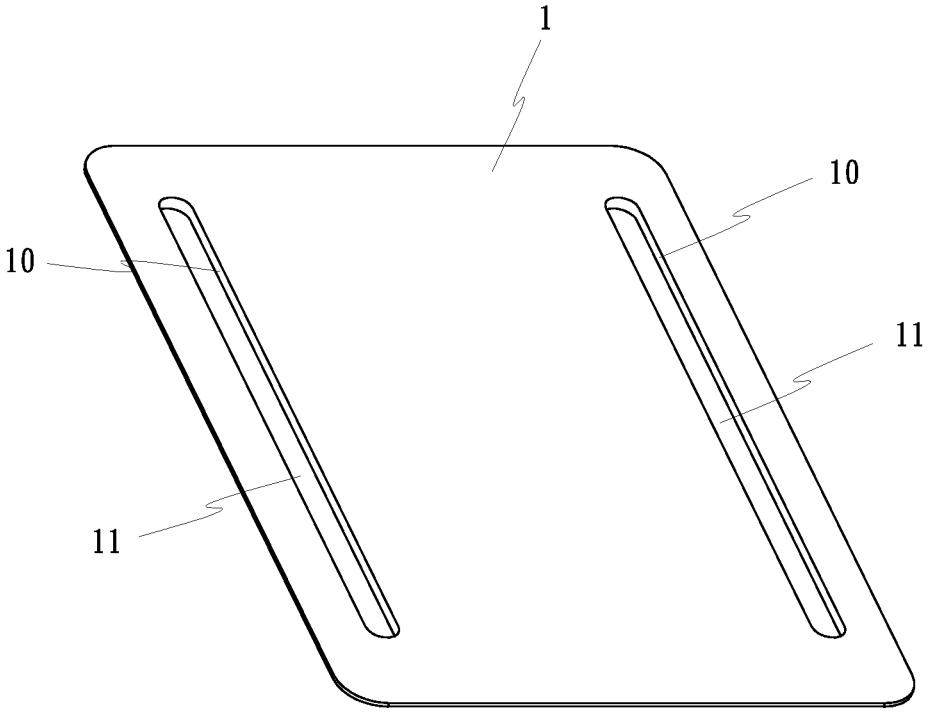
FIG. 10 illustrates flanged holes formed in the metal heat transfer plate after the second step of the metal heat transfer plate and heat pipe mounting method in accordance with the present invention.
Figure 11:
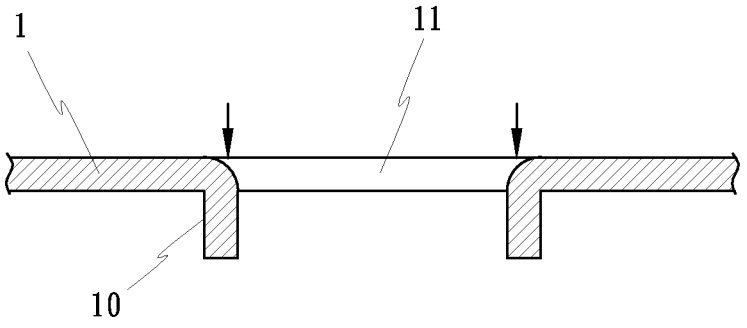
FIG. 11 is a sectional view of the metal heat transfer plate shown in FIG. 10.

Step II (flanged hole creation): Employ stamping and extruding techniques to process each mounting slot 11 of the metal heat transfer plate 1 into a respective flanged hole 10 (see FIG. 10 and FIG. 11) having an elongated flange at one side of the metal heat transfer plate 1.

Figure 12:
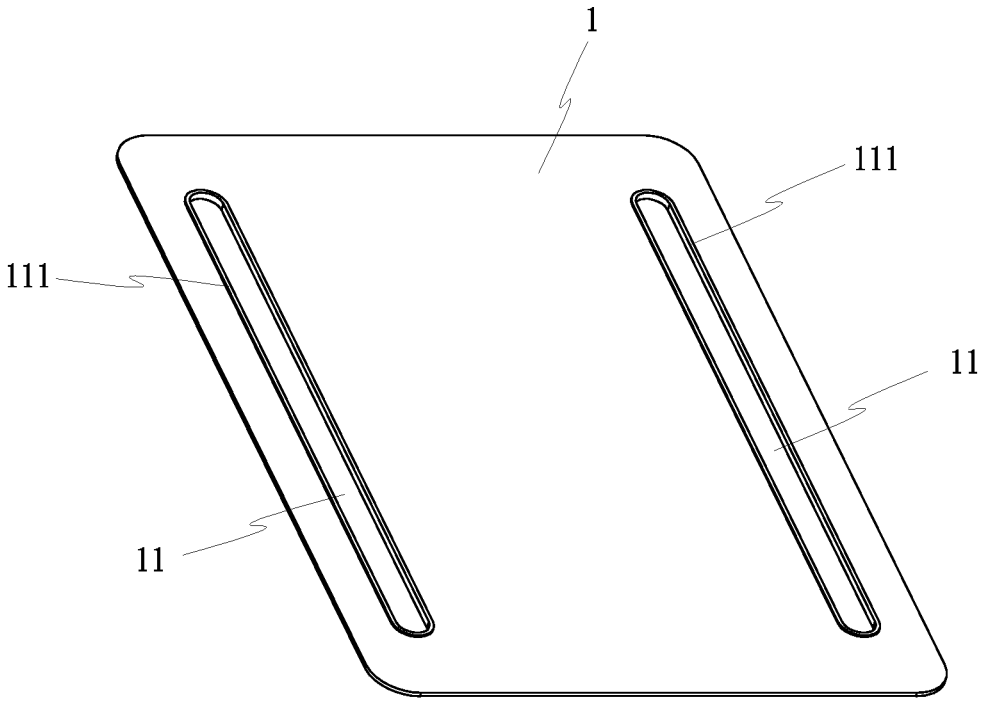
FIG. 12 illustrates top and bottom protruding flanges formed on the metal heat transfer plate after the third step of the metal heat transfer plate and heat pipe mounting method in accordance with the present invention.
Figure 13:
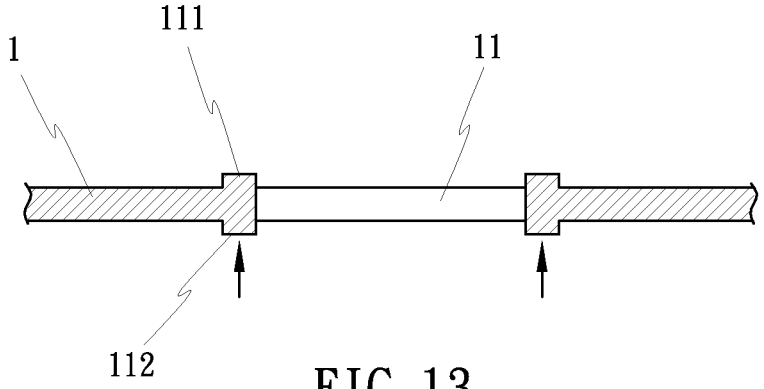
FIG. 13 is a sectional view of the metal heat transfer plate shown in FIG. 12.

Step III: Stamp each flanged hole 10 in the reversed direction, causing formation of a top protruding flange 111 and a bottom protruding flange 112 at opposing top and bottom surfaces of the metal heat transfer plate 1 around each mounting slot 11 (see FIG. 12 and FIG. 13).

Figure 14:
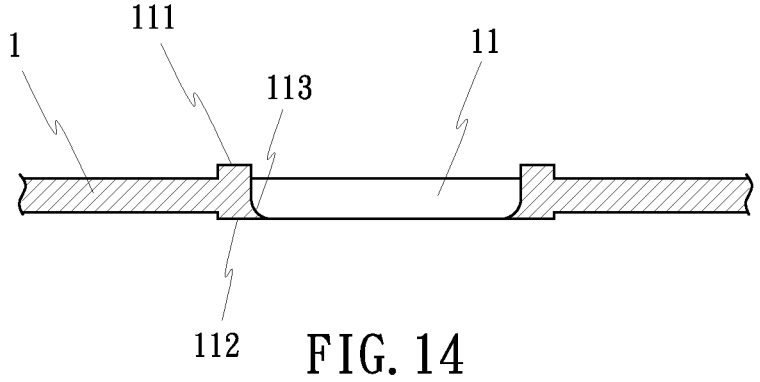
FIG. 14 is a sectional view of the metal heat transfer plate after the fourth step of the metal heat transfer plate and heat pipe mounting method in accordance with the present invention.

Step IV: Stamp the bottom protruding flange 112 of each mounting slot 11 to create an insertion chamber 113 in each mounting slot 11, enabling each created insertion chamber 113 to be surrounded by the respective top and bottom protruding flanges 111;112 (see FIG. 14).

Figure 15:
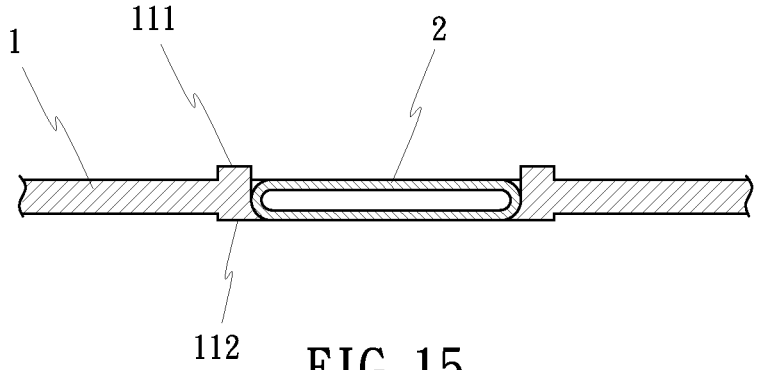
FIG. 15 is a sectional view illustrating the fifth step of the metal heat transfer plate and heat pipe mounting method in accordance with the present invention.
Figure 16:
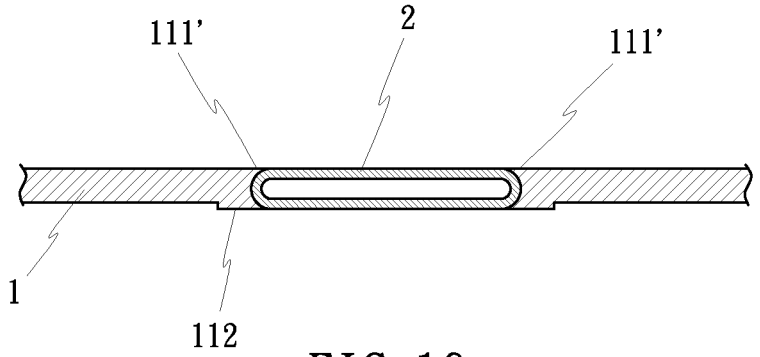
FIG. 16 is a sectional view illustrating the metal heat transfer plate and heat pipe mounting structure finished after the fifth step of the metal heat transfer plate and heat pipe mounting method in accordance with the present invention.

Step V: Press-fit each flat heat pipe 2 into one respective mounting slot 11 in the metal heat transfer plate 1 (see FIG. 15), and then stamp the top protruding flange 111 around each mounting slot 11 into a respective deformed top protruding flange 111' to wrap about the respective heat pipe 2, keeping each deformed top protruding flange 111' flush with the top surface of the metal heat transfer plate 1 and each heat pipe 2 (see FIG. 16).

Figure 17:
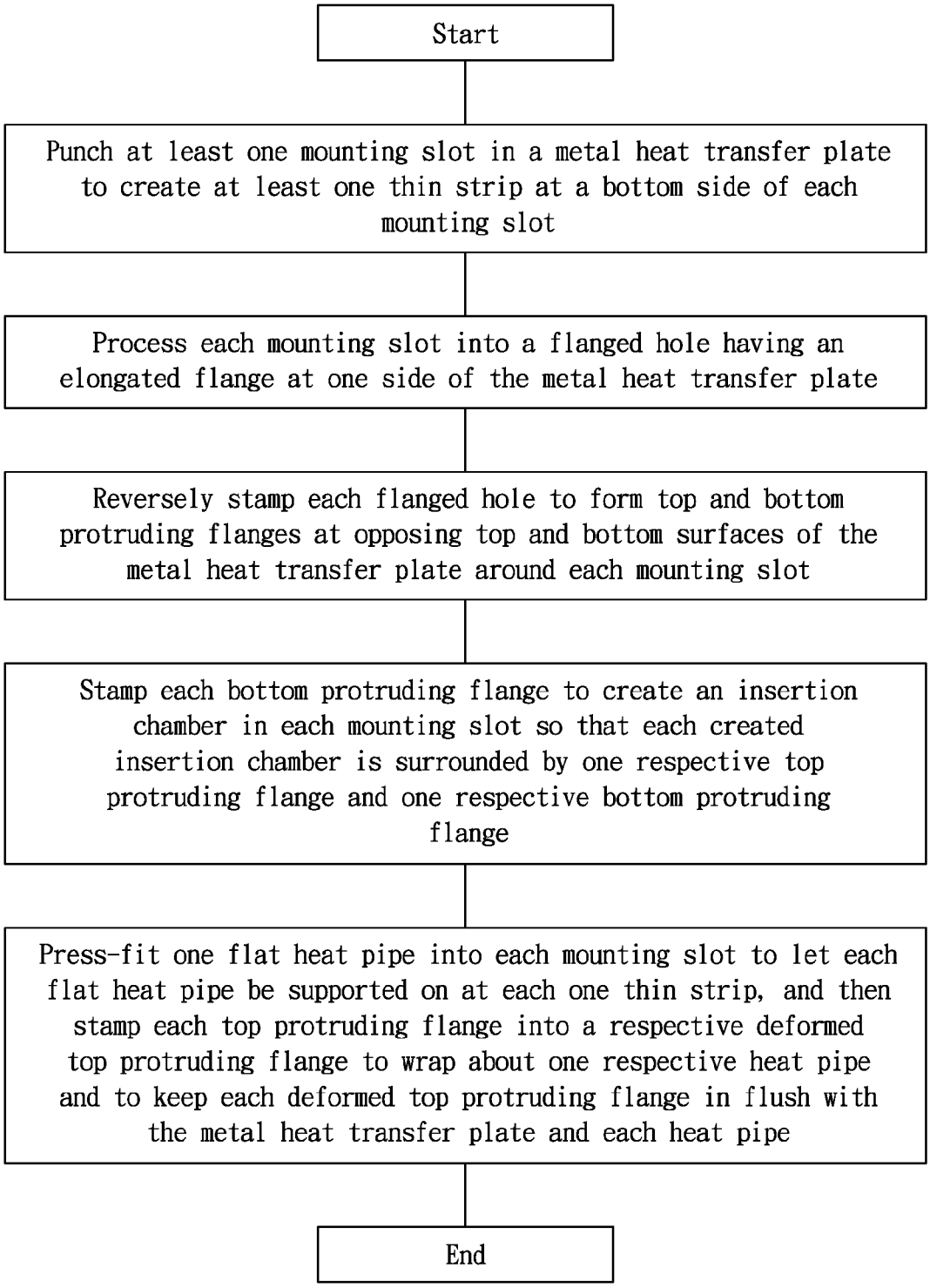
FIG. 17 is a manufacturing flow chart of the second embodiment of the present invention.
Figure 18:
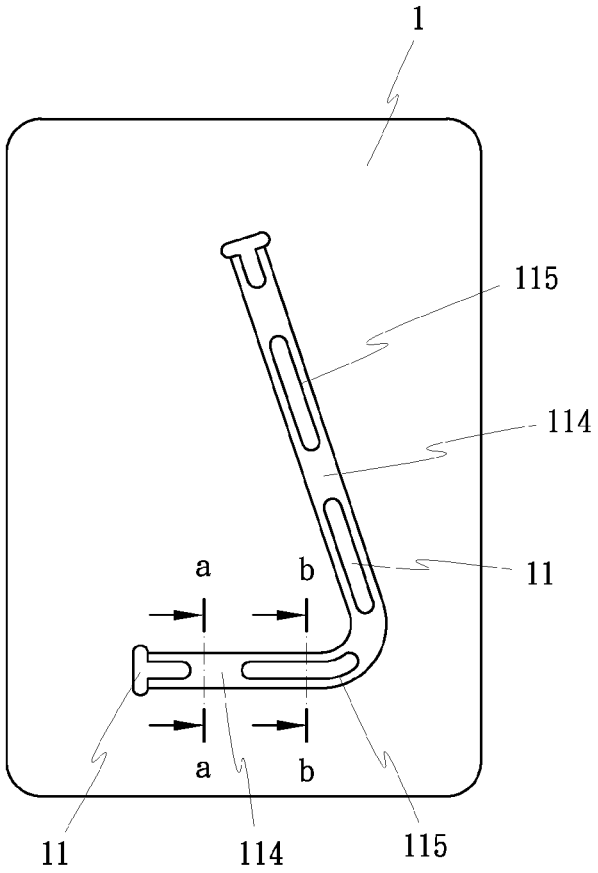
FIG. 18 is top view of a metal heat transfer plate and heat pipe mounting structure in accordance with a third embodiment of the present invention.
Figure 19:
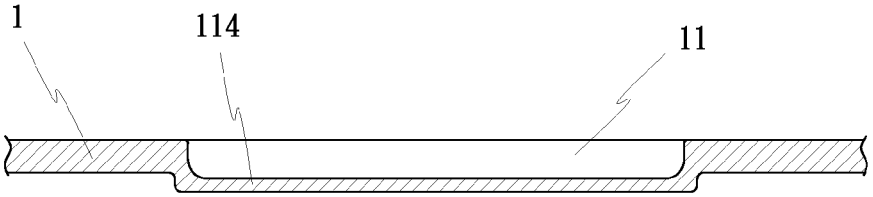
FIG. 19 is a sectional view taken long line a-a of FIG. 18.
Figure 20:
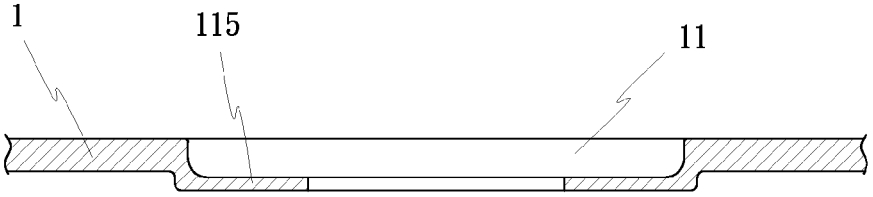
FIG. 20 is a sectional view taken along line b-b of FIG. 18.
Figure 21:
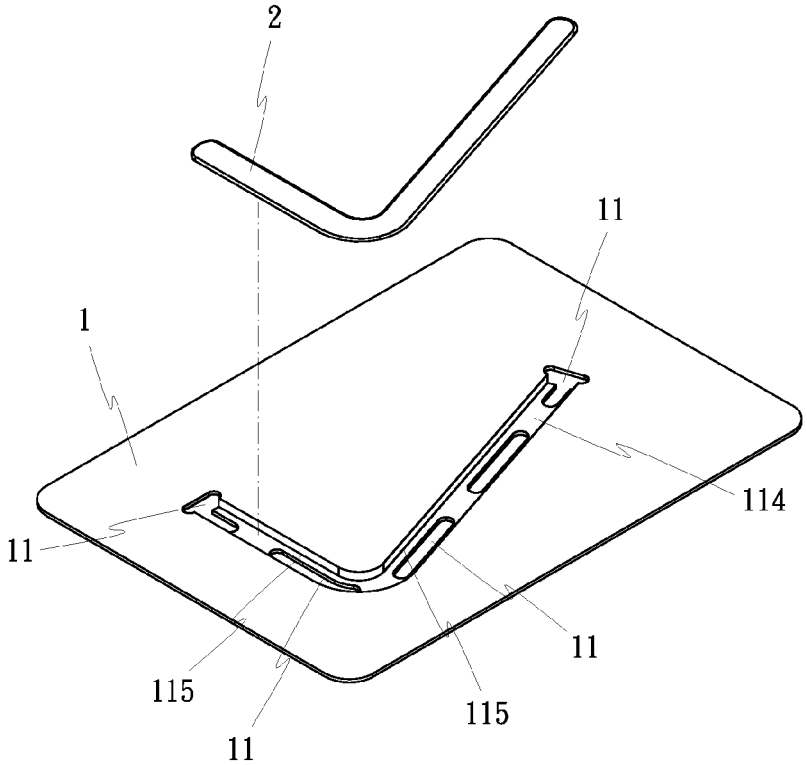
FIG. 21 is an exploded view of the metal heat transfer plate and heat pipe mounting structure in accordance with the third embodiment of the present invention.
Figure 22:
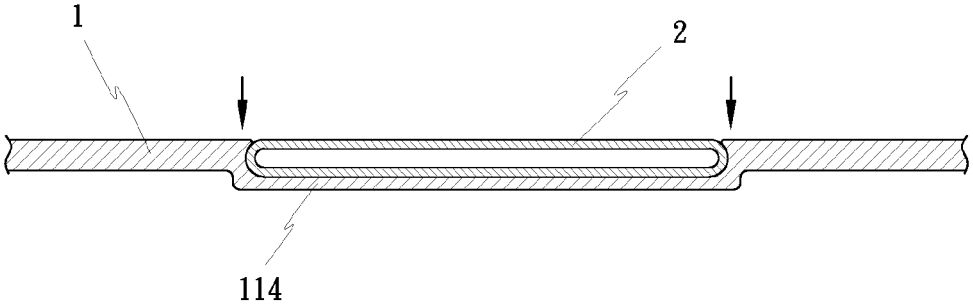
FIG. 22 is a sectional assembly view of FIG. 21.

Referring to FIG. 17, the metal heat transfer plate and heat pipe mounting method for making the aforesaid metal heat transfer plate and heat pipe mounting structure in accordance with the second embodiment of the present invention is substantially similar to the aforesaid first embodiment with the exception that punching one or a plurality of mounting slots 11 in the metal heat transfer plate 1 in Step I simultaneously creates at least one thin strip 114 at a bottom side of each mounting slot 11, thus, after each flat heat pipe 2 is press-fitted into one respective mounting slot 11 in the metal heat transfer plate 1 and then the top protruding flange 111 is stamped around each mounting slot 11 into a respective deformed top protruding flange 111' to wrap about the respective heat pipe 2, each heat pipe 2 is supported on at least one thin strip 114 (see FIG. 6), thus enhancing positioning stability of each heat pipe 2 in the metal heat transfer plate 1.

Referring to FIGS. 18-22, a metal heat transfer plate and heat pipe mounting structure in accordance with a third embodiment of the present invention is shown. According to this embodiment, thin strips 114 are transversely connected between two opposite lateral sides of each mounting slot 11 and suspending at the bottom side of the metal heat transfer plate 1; the extension strips 115 are respectively extended from the thin strips 114 and connected to the border area of each mounting slot 11 or between two of the thin strips 114. After one heat pipe 2 is press-fitted into one respective mounting slot 11 in the metal heat transfer plate 1, the thin strips 114 and the extension strips 115 support each installed heat pipe 2 in each respective mounting slot 11 firmly in place (see FIG. 22).

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A metal heat transfer plate and heat pipe mounting method, comprising the steps of:

(1) punching at least one mounting slot in a metal heat transfer plate;

(2) employing stamping and extruding techniques to process each said mounting slot into a respective flanged hole having an elongated flange at one side of said metal heat transfer plate;

(3) reversely stamping each said flanged hole to form a top protruding flange and a bottom protruding flange at opposing top and bottom surfaces of said metal heat transfer plate around each said mounting slot;

(4) stamping each said bottom protruding flange to create an insertion chamber in each said mounting slot so that each said insertion chamber is surrounded by one respective said top protruding flange and one respective said bottom protruding flange; and (5) press-fitting one flat heat pipe into each said mounting slot in the metal heat transfer plate, and then stamping each said top protruding flange around each said mounting slot into a respective deformed top protruding flange to wrap about one respective said heat pipe and to keep each said deformed top protruding flange flush with the top surface of said metal heat transfer plate and each said heat pipe.

* * * * *